United States Patent [19]

Schmidt et al.

[11] 4,354,703

[45] Oct. 19, 1982

[54] METHOD OF AND APPARATUS FOR TRANSPORTING ARTICLES

[75] Inventors: Peter Schmidt, Denkendorf; Emil Mühlberger, Esslingen, both of Fed. Rep. of Germany

[73] Assignee: International Standard Electric Corporation, New York, N.Y.

[21] Appl. No.: 174,404

[22] Filed: Aug. 1, 1980

[30] Foreign Application Priority Data

Aug. 7, 1979 [DE] Fed. Rep. of Germany ..... 2931927

[51] Int. Cl.[3] ..... B66C 1/02

[52] U.S. Cl. ..... 294/64 R

[58] Field of Search ..... 294/64 R, 64 A, 64 B, 294/65, 103; 414/627, 723; 254/390

[56] References Cited

U.S. PATENT DOCUMENTS

| | | | |
|---|---|---|---|
| 2,823,896 | 2/1958 | Hood . | |
| 3,272,549 | 9/1966 | Nisala | 294/64 R |
| 3,609,938 | 10/1971 | Paddock | 294/64 R |
| 3,696,596 | 10/1972 | Wegscheid | 294/64 R |
| 3,791,627 | 2/1979 | Stone et al. . | |
| 3,933,388 | 1/1976 | Conboy | 294/64 R |
| 3,974,919 | 8/1976 | Bokalders | 294/64 R |

*Primary Examiner*—James B. Marbert

*Attorney, Agent, or Firm*—John T. O'Halloran; Robert E. Lee, Jr.

[57] ABSTRACT

A transport aid is disclosed wherein the article to be transported is lightened by a constant hoisting power. The invention can be used to transport articles which are sensitive to shock and too heavy for manual transport, such as large TV-picture tubes.

12 Claims, 2 Drawing Figures

Figure 1:
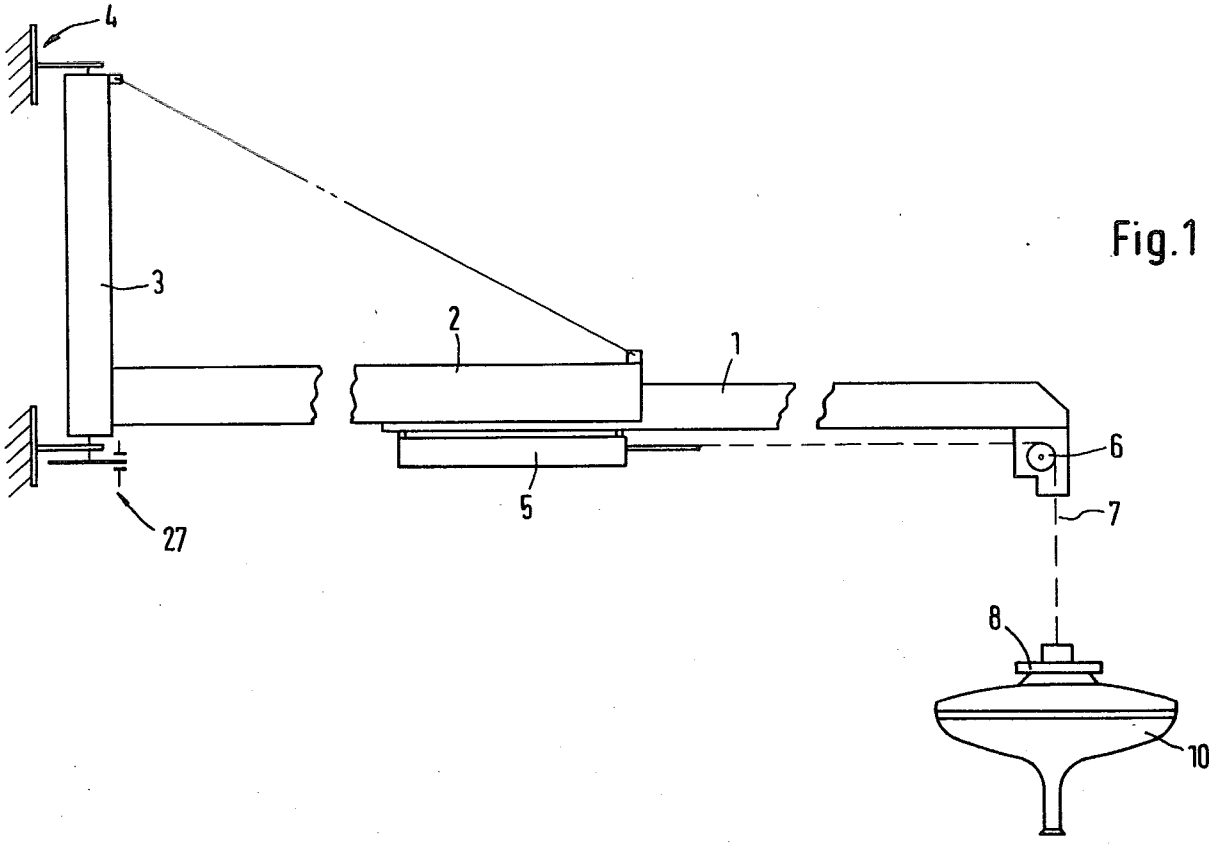

4
3
27
2
1
5
6
7
8
10

METHOD OF AND APPARATUS FOR TRANSPORTING ARTICLES

The present invention relates to a method of and an apparatus for facilitating the manual and mechanical transport of articles and more particularly of articles which are sensitive to shock and difficult to handle manually because of their weight.

Man has always endeavoured to make it easier for himself to transport articles, particularly if this activity becomes very strenuous with increasing weight and/or with increasing duration and/or frequency of transport, and if, in the case of articles sensitive to shock, the risk of damage to the article grows with the increasing effort, because the safety of the person carrying the article decreases.

Methods and apparatuses are known which facilitate the transport of an article by raising the article by mechanical force, shifting it horizontally by manual and/or mechanical forces, and then lowering it by mechanical force, as is done with conventional building cranes, for example.

If articles are transported in this way, it has turned out in practice that, if the risk of damage is to be avoided, articles sensitive to shock can be safely guided only if moved very slowly, especially when being lowered.

Other apparatus is known, e.g. from conveyor belt production, with which the transport can be carried out only by mechanical forces and essentially by means of mechanical control gear. Such apparatus is comparatively costly, and its application is limited to transport over predetermined paths of travel.

The object of the invention is to provide a method and an apparatus which permit articles sensitive to shock and difficult to handle manually because of their weight to be transported safely and quickly by simple means.

This object is achieved by subjecting the grab in an unloaded condition to a first mechanical hoisting power of predetermined magnitude in relation to the weight of the grab, manually guiding the grab onto the article and during transport, subjecting the grab in a loaded condition to a second mechanical hoisting power which is higher than that acting on the unloaded grab, and has a predetermined relationship to the weight of the loaded grab, and providing a changeover switch for changing from the second to the first mechanical hoisting power.

The invention has the advantage of largely exempting man from the need to lift weights while making use of man's good ability to safely guide and position an article and to easily adapt oneself to changing transport conditions, such as changing transport paths or different articles. Thus, the invention has the added advantage of being usable on changing and difficult-to-determine, varying transport paths, too.

It has turned out in practice that with the transporting method according to the invention, the risk of damage to articles sensitive to shock is minimized if the mechanical hoisting power is smaller than the sum of the weights of the article and the grab. A preferred value for the hoisting power is about 90 percent of that weight sum.

If the method according to the invention is used to transport picture tubes, it is possible to overcome transport difficulties that have existed in the manufacture of picture tubes for a long time.

The apparatus for carrying out the method according to the invention is especially easy to handle if a changeover switch for changing the magnitude of the hoisting power is fitted to the grab. This permits the magnitude of the hoisting power to be adapted to the respective load directly at the grab.

The manipulation of the apparatus is further facilitated if an upper stop is provided for limiting the upward movement of the grab, and if in one of the positions of the change-over switch a hoisting power is effective whose magnitude just suffices to cause the unloaded grab to move to the upper stop without manual forces. As a result, only small manual forces are required to move the grab toward, and remove it from, the article, and at the end of the transfer, the grab returns to a defined rest position without manual aid.

For the transport of articles with sufficiently smooth and even surface, it has proved especially advantageous to design the grab as a suction device.

The operation of the suction device is greatly facilitated if the device is fitted with a sensor switch which, when the device comes into contact with the article, switches on the suction vacuum, or if the device or the vacuum line is provided with a minimum-pressure governor which switches the magnitude of the hoisting power to a higher value when a required vacuum is reached.

It has turned out that particularly uniform and constant hoisting power and, hence, particularly easy and safe transport are provided if the mechanical hoisting power is generated by means of an air cylinder whose pressure is maintained at a predetermined value.

An apparatus in which the mechanical hoisting power is transmitted from the movable end of a horizontal, telescopic jib is transmitted to the suspended grab by a rope or a chain, and in which this jib is rotatable about its fixed end in a horizontal plane has the advantage that the article is easy to move in a horizontal plane.

Figure 2:
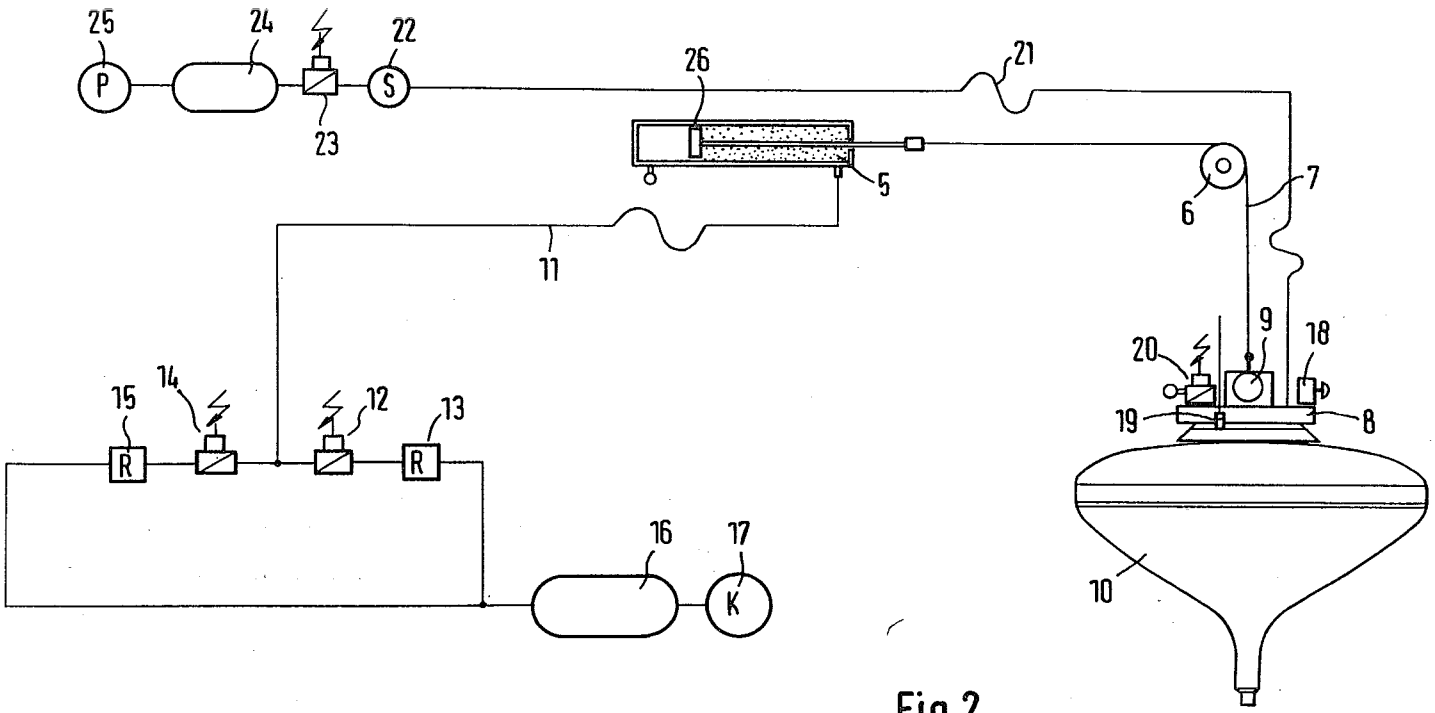

An embodiment of the invention will now be explained in more detail with reference to the accompanying drawings, in which:

FIG. 1 shows the essential carrying parts of an embodiment of an apparatus according to the invention, and FIG. 2 shows schematically the essential control elements for the apparatus of FIG. 1.

The apparatus of FIG. 1 has a jib consisting of a telescopic part 1 and a part 2 rigidly connected with a vertical post 3.

The vertical post 3 is rotatable about its axis. It is lockable by means of a holding brake 27 and attached to a wall 4 or to another suitable support. Mounted near that end of the telescopic part 1 of the jib which is near the pivot point is an air cylinder 5, which extends parallel to the jib. At the outer end of this part 1 is a rope pulley 6, by which the forces originating from the air cylinder 5 are deflected, via a rope or a chain 7, to a grab 8 suspended below the pulley 6. In the example shown, the grab 8 is designed as a suction device, so it is suitable for transporting articles 10 with sufficiently smooth and even surface, such as picture tubes (shown in the drawings).

FIG. 2 shows schematically the control of the compressed air for the air cylinder 5 and of the vacuum for the suction device 8 of the apparatus of FIG. 1. Elements having the same functions as in FIG. 1 are designated by like reference characters.

The air cylinder 5 is connected to a compressed-air vessel 16 and a following compressor 17 by a compressed-air line 11 either via a pneumatic valve 12 and a pressure control 13 or via a pneumatic valve 14 and a pressure control 15.

The suction device 8 is provided with a sensor switch 19, which turns on as soon as the suction device touches an article 10, and an air-bleed valve 20, which permits the vacuum in the suction device 8 to be relieved, and with a handle 9 for the manual guidance of the suction device. In addition, the suction device 8 is fitted with a change-over switch 18 for switching the pneumatic valves 12 and 14.

The suction device 8 is connected to a vacuum vessel 24 followed by a vacuum pump 25 via a vacuum line 21 containing a vacuum valve 23. A minimum-pressure governor 22 switches the pneumatic valves 12 and 14 as soon as a required vacuum is reached in the vacuum line 21.

The apparatus operates as follows.

In its rest position, the suction device 8 rests against an upper stop, which, in this example, is defined by the fact that the piston 26 of the air cylinder 5 has fully moved into the cylinder. To place or keep the suction device in this position, the air cylinder is supplied, via the pneumatic valve 14 and the pressure control 15, with an air pressure which just suffices to slowly return the unloaded suction device to its rest position without manual forces. At this low air-pressure setting, the suction device can be pulled down to, and placed on the article 10 by the handle 9 with relatively little effort. Despite the moving piston 26, the air pressure in the air cylinder 5 is maintained constant by the pressure control 15.

As the suction device 8 is put on the article 10, the sensor switch 19 is actuated and causes the vacuum valve 23 to open. The vacuum being created between the suction device 8 and the article 10 presses the two parts together so firmly that the article 10 is held in place. When the vacuum has reached the value sufficient for this, the minimum-pressure governor 22 is operated and causes a change-over from the pneumatic valve 14 to the pneumatic valve 12. The pressure control 13 now raises the air pressure in the air cylinder 5 to a higher value, thereby increasing the hoisting power exerted on the article 10 via the suction device 8.

The article 10, so reduced in weight by the hoisting power of the apparatus, can now be easily raised and carried to another place by the handle 9 or by taking it directly. During vertical movements, the hoisting power is mantained constant by the air pressure of the air cylinder 5, which is maintained constant by the pressure control 13.

The vertical range of movement is defined by the length of the air cylinder 5, while the horizontal range of movement is defined by the swing and the telescopic range of the jib.

To ease the horizontal movement, the apparatus is made as light as possible and with easily working parts in relative motion.

After the article 10 has been lowered in its new place, the change over switch 18 is actuated, whereby change-over from the pneumatic valve 12 to the pneumatic valve 14 is effected to reduce the hoisting power. In addition, the vacuum valve 23 is closed and the air-bleed valve 20 is opened. This removes the suction between the suction device 8 and the article 10, and the suction device 8 returns to its rest position without the article 10, as described at the beginning. A holding brake 27 prevents the jib from being swung out of the rest position when the suction device is unloaded.

We claim:

1. A method of facilitating the manual and mechanical transport of articles using a grab comprising:

subjecting the grab in an unloaded condition to a first mechanical hoisting power of predetermined magnitude in relation to the weight of the grab, manually guiding said grab onto the article and during transport, subjecting said grab in a loaded condition to a second mechanical hoisting power which is higher than that acting on the unloaded grab, and smaller than the weight of the loaded grab, and removing the article from said grab and then switching from said second to said first mechanical hoisting power.

2. The method as claimed in claim 1, wherein said second mechanical hoisting power acting on the loaded grab is about 90 percent of the sum of the weights of the article and the grab.

3. The method as claimed in claim 1, for use in transporting picture tubes.

4. Apparatus for the transport of articles comprising:

a frame structure, a grab attached to said frame structure, first means connected to said frame structure and said grab for subjecting said grab to a mechanical hoisting power of a first magnitude, said magnitude having a predetermined value in relation to the weight of said grab, second means connected to said frame structure and said grab for subjecting said grab to a mechanical hoisting power of a second magnitude, said second magnitude being smaller than the sum of the weights of the article and the grab, and a change-over switch located on said grab and connected to said first and said second means for changing the mechanical hoisting power.

5. The apparatus as claimed in claim 4, further comprising a sensor switch located on said grab, so that when said grab comes into contact with the article, said switch changes the mechanical hoisting power from said first magnitude to said second magnitude.

6. The apparatus as claimed in claim 4, wherein said grab is a suction device.

7. The apparatus as claimed in claim 6, further comprising a sensor switch located on said suction device for activating the suction vacuum when said suction device contacts the article.

8. The apparatus as claimed in claim 7, further comprising a minimum-pressure governor connected to said suction device for switching to said second magnitude hoisting power when a required vacuum is reached.

9. The apparatus as claimed in any one of claims 4 to 8, further comprising an upper stop for the upward movement of the grab, and that in one of the positions of the change-over switch, a hoisting power is effective whose magnitude just suffices to cause the unloaded grab to move to the upper stop without manual forces.

10. The apparatus as claimed in claim 4 wherein said first means for subjecting said grab to a first magnitude mechanical hoisting power comprises an air cylinder and a first pressure control assembly for maintaining the pressure at a predetermined value.

11. The apparatus as claimed in claim 4 wherein said rotatable and telescopic frame structure comprises a telescoping jib having a movable end and a fixed end, said jib being rotatable about said fixed end in a horizontal plane, and a rope movably attached to said grab and said mechanical hoisting power.

12. The apparatus as claimed in claim 4 wherein said second means for subjecting said grab to a second magnitude mechanical hoisting power comprises an air cylinder and a second pressure control assembly for maintaining said pressure at a predetermined value.

* * * * *